United States Patent [19]

Batts

[11] 4,071,146

[45] Jan. 31, 1978

[54] ARTICULATED ARTICLE SUPPORT

[75] Inventor: John H. Batts, Grand Rapids, Mich.

[73] Assignee: John Thomas Batts, Inc., Zeeland, Mich.

[21] Appl. No.: 646,178

[22] Filed: Jan. 2, 1976

[51] Int. Cl.[2] ..... A47F 7/19

[52] U.S. Cl. ..... 211/87; 211/118; 224/42.46 A; 248/307

[58] Field of Search ..... 211/113, 86, 87, 118, 211/13; 248/316 C, 316 R, 317, 304, 301, 339, 307, 323, 321, 342, 205 R; 224/42.46 R, 42.46 A, 42.45 R, 42.45 A, 45 T, 5 R; 24/265 R, 265 EC, 265 C

[56] References Cited

U.S. PATENT DOCUMENTS

| | | | |
|---|---|---|---|
| D. 190,608 | | Forrester | D8/372 |
| 452,582 | 5/1891 | Pilkington | 24/265 EC X |
| 980,269 | 1/1911 | Hunold | 24/265 EC |
| 2,039,758 | 5/1936 | Wayne | 211/99 |
| 2,532,022 | 11/1950 | Gunderson | 211/89 |
| 2,593,356 | 4/1952 | Smith | 211/119 |
| 2,609,104 | 9/1952 | Leach | 224/42.45 A |
| 2,742,208 | 4/1956 | Kraft | 223/88 |
| 2,832,399 | 4/1958 | Varkala | 24/265 C |
| 2,941,672 | 6/1960 | Lathrop | 211/87 |
| 3,175,031 | 3/1965 | Reiner | 248/316 R X |
| 3,224,596 | 12/1965 | Becker | 211/113 |
| 3,584,746 | 6/1971 | Marchman | 211/116 |
| 3,669,276 | 6/1972 | Woods | 211/34 |
| 3,868,080 | 2/1975 | Olson | 248/205 R |
| 3,900,110 | 8/1975 | Soroka | 211/113 |

FOREIGN PATENT DOCUMENTS

| | | | |
|---|---|---|---|
| 168,191 | 4/1951 | Austria | 211/87 |
| 491,443 | 1/1930 | Germany | 248/304 |

*Primary Examiner*—Roy D. Frazier
*Assistant Examiner*—Robert W. Gibson, Jr.
*Attorney, Agent, or Firm*—Price Heneveld, Huizenga & Cooper

[57] ABSTRACT

An articulated article support for hook suspended article display devices includes an elongated, flexible, tension load supporting member upon which a plurality of links are mounted in a tandem relationship. Each of the links includes a generally rectangular shaped body having a hook extending outwardly therefrom. Various attachment arrangements are provided for securing one end of the load supporting member to a support surface.

33 Claims, 16 Drawing Figures

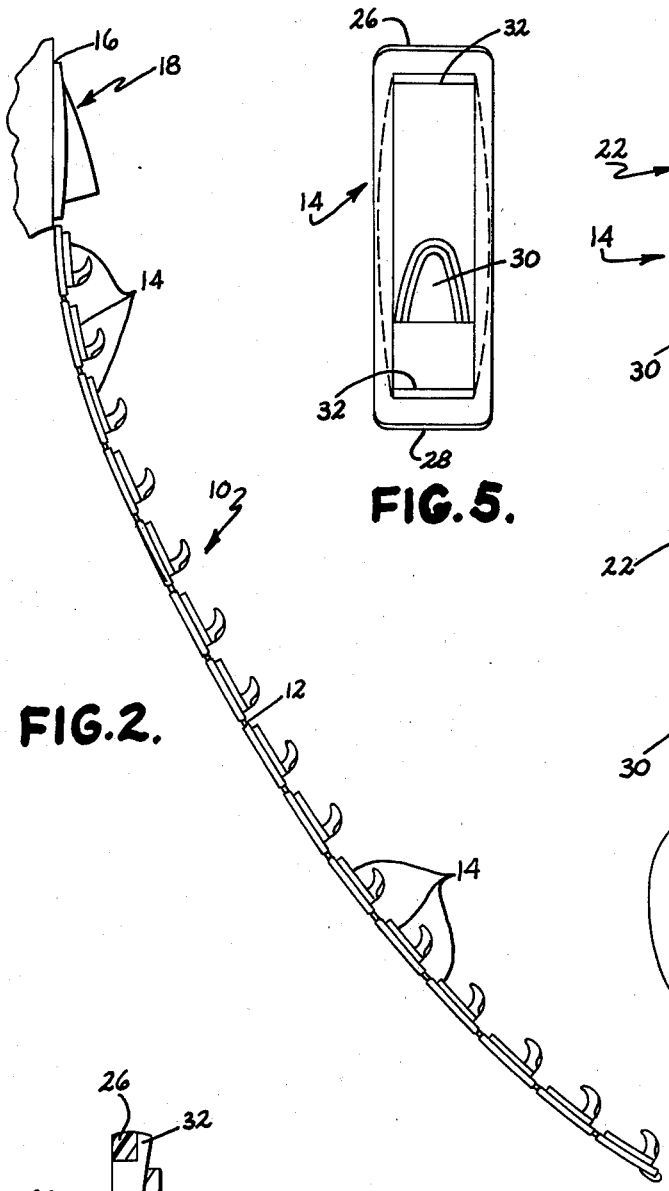
FIG. 2.
FIG. 5.
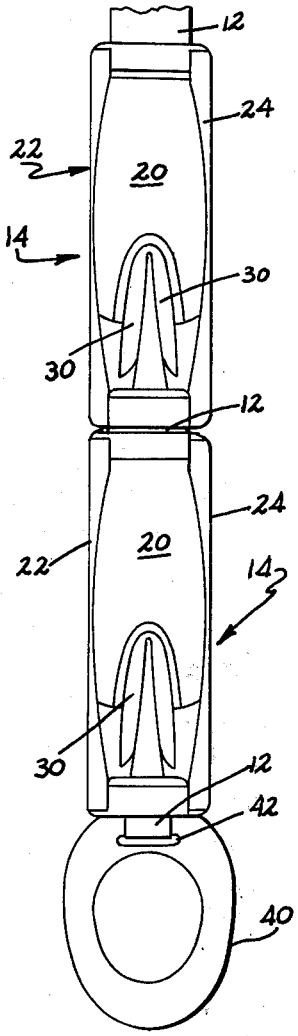
FIG. 3.
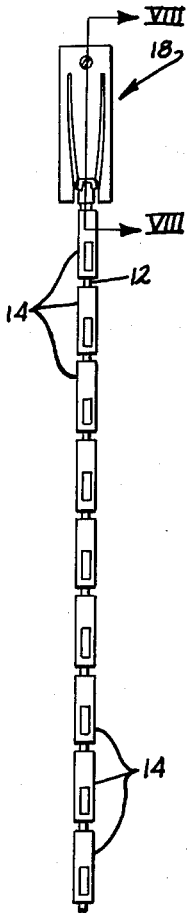
FIG. 1.
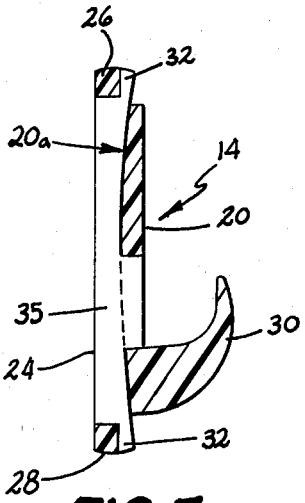
FIG. 7.
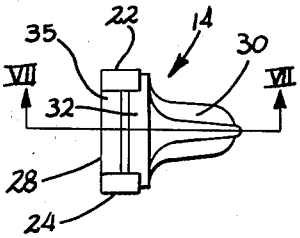
FIG. 6.
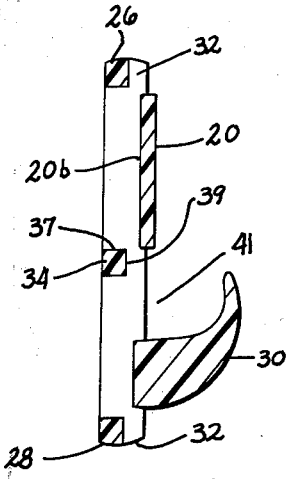
FIG. 16.

ARTICULATED ARTICLE SUPPORT

BACKGROUND OF THE INVENTION

This invention relates to display arrangements and more particularly to a unique arrangement for supporting a plurality of hook suspended article display devices in a spaced, vertical relationship.

In the wholesaling and retailing of garments, carpets, wall coverings, household wares such as toweling, and numerous other areas of merchandising, a need exists for a simple support for a plurality of hook suspended article display devices. By supporting the hooked devices in a vertically spaced relationship, a plurality of articles may be displayed together either to produce a desired visual blend or to provide a ready means of comparison and contrast. For example, a plurality of differently colored or styled shirts, blouses, suits or pants could all be displayed with a portion of each visible to the customer. Also, a variety of different carpet samples could be displayed, each having the same design and different colors or textures or with design and color variations.

Various forms of devices are known for supporting a plurality of hook suspended garment hangers and the like in a spaced vertical relationship. An example of one such device may be found in U.S. Pat. No. 2,039,758 to Wayne entitled "Extendible Garment Support" issued on May 5, 1936. This patent discloses a rigid arm having a plurality of longitudinally spaced notches formed in one lateral edge thereof. One end of the arm is pivotally secured to a bracket which in turn is securable to a support surface. The hooks of a plurality of garment hangers may be placed in each of the notches. The arm is tiltable upwardly so that the garments are separated for ease of removal and return. The support arm in this device is a rigid structural member which is rather bulky in nature. As a result, the length of the member and hence the number of hook suspended article display devices which may be supported therefrom is limited due to the resulting increase in weight, bulkiness, and effort required to swing the rigid support arm from a vertical position outwardly away from the support surface. Another example of a prior arrangement may be found in U.S. Pat. No. 3,224,596 to Becker entitled "Clothes Hanger Support" and issued on Dec. 21, 1965. As with the above described arrangement, this latter patent also discloses a support including a rigid support arm.

A need therefore exists for a simple display arrangement whereby the aformentioned highly desirable capabilities may be obtained but at a reduced cost, with a more aesthetically pleasing appearance than heretofore available, and which requires less effort to swing the support outwardly away from a support surface to thereby separate the articles suspended from it.

SUMMARY OF THE INVENTION

In accordance with the present invention, a unique, articulated article support is provided for hook suspended article display devices. Essentially, the articulated article support includes an elongated, flexible tension load supporting member upon which a plurality of links are mounted in an end-to-end or tandem relationship. Each of the links includes an elongated, rigid body having a hook projecting from one face thereof. Provision is made for securing one end of the load supporting member to a support.

BRIEF DESCRIPTION OF THE DRAWINGS

FIG. 1 is a front elevational view of the articulated support in accordance with the present invention;

FIG. 2 is a side elevational view of the articulated support of FIG. 1;

FIG. 3 is an enlarged fragmentary view of the lower portion of the articulated support in accordance with the present invention;

FIG. 5 is a rear elevational view of one of the links employed with the present invention;

FIG. 6 is an end view of the link of FIG. 5;

FIG. 7 is a cross-sectional view taken generally along line VII—VII of FIG. 6;

FIG. 16 is a cross-sectional, side elevational view showing an alternative form of the link.

DETAILED DESCRIPTION OF THE PREFERRED EMBODIMENT

Figure 4:
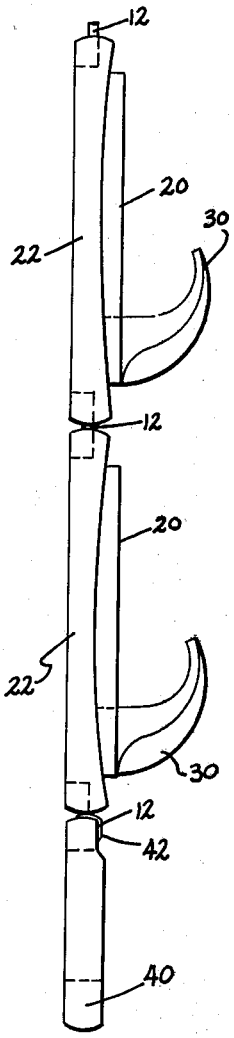
FIG. 4 is an enlarged fragmentary side elevational view of the lower portion of the articulated support.

The preferred embodiment of an articulated article support in accordance with the present invention is illustrated in the drawings and generally designated 10. The articulated support 10 basically includes an elongated, flexible tension load supporting member 12 upon which are slidably disposed a plurality of links 14. The tension member 12 is secured at its upper side end to a support surface 16 by an attachment arrangement 18.

As best seen in FIGS. 5, 6 and 7, each individual link 14 includes an elongated, rigid body having a top wall 20, depending side walls 22, 24, and end walls 26, 28. A hook 30 extends outwardly from the top wall or front face 20 of each link. The hook 30 is adapted to support the hook of an article display device. Further, the end walls 26, 28 and the end portions of the top wall 20 are formed with slots 32 therein (FIG. 7). The links are easily manufactured from rigid plastic material through conventional molding techniques.

The tension member 12 preferably takes the form of an elongated plastic supporting member or strap-like member having a width substantially greater than its thickness. The plastic strap is dimensioned so as to be insertable through the slots 32 of the link 14. In the preferred form, a plurality of links 14 are slidably positioned on an elongated strap. The strap is looped around the end wall 28 of the lowermost link and then passed back upwardly through the slots of the preceding links.

In this manner, the links 14 are retained on the load bearing member and a double thickness is provided to increase the load carrying capacity of the article support.

A feature of each of the links 14 is the arcuate shape in cross section of the inner face 20a of the top wall of the link (FIG. 7). It will be noted that this curvature forces the tension member or strap 12 to trace a curved path through a passageway through each link. This has several beneficial effects. First, when the strap is tensioned under load, this assures a firm, positive, full face engagement between the strap and the adjacent surfaces of both the wall 20 and the end walls 26 and 28. Thus, no slop or play remains between the strap and the link which would result in twisting, rotation or misadjustment with respect to the strap of the link. This is important because it assures uniform alignment of the suspended articles and, thus, their most advantageous display.

A second advantage of this arrangement wherein portions of the inner face of the top wall are offset normal to the plane of the strap is an increase in the frictional engagement between the strap and the link. This, to some degree, relieves the lower end of the strap from the full weight of the suspended articles. This also aids in assembling the links by limiting their freedom to slide along the strap 12.

Another feature of the links 14, important to their effective function, is the fact that laterally their ends are straight but in a front to back direction they are rounded or arcuate (FIGS. 4 and 7). If the rounding were omitted, when the bottom end of the article support was pulled outwardly as illustrated in FIG. 2, the links would rock about the abutment of their front end corners, resulting in a severe tension load being applied to the strap 12 because the links would separate at the plane of the strap. Along the entire length of the article support this would either stretch the strap 12 or place so severe a strain on it as to result in early failure. If the strap stretched, it would soon result in an unacceptable elongation of the strap.

It will be noted that the top wall 20 is omitted forwardly of the hook 30, rearwardly of the end wall 26 and forwardly of the end wall 28. Thus, the links can be molded in a simple, two part mold without the use of inserts or cams. This materially reduces the cost of the tooling, extends it life and shortens the molding cycle.

It will also be observed from FIGS. 6 and 7 that the side walls define a lengthwise oriented channel or passage 35 which extends the full length of the link and includes slots 32. This passage 35 has a width just sufficient to accommodate the strap 12. This arrangement prevents any pivoting of the link in the plane of the strap.

An alternative arrangement is illustrated in FIG. 16. With this arrangement the inner face 20b of the top wall is substantially flat or planar. A transverse web 34 is formed integral with or secured between the side walls 22, 24. The upper face 37 is positioned so that the top face 39 opens within the aperture 41 between the rear edge of top wall 20 and forward of the tip of the hook 30.

The web is dimensioned so that the strap 12 curves around the web 34 to trace a serpentine path as it passed through the slots 32. The web therefore increases the frictional force between the strap and the inner surface **20*b* of top wall 20**. The web also insures full face engagement of the strap with the wall and exerts a frictional force on the underside of the strap.

The positioning of the web permits molding of the link is a simple two part mold without the use of inserts or cams.

With reference to FIG. 2, any form of hook suspended article display device such as garment hangers or carpet sample hangers are supportable on the articulated support. The hook portion of each of these hangers is positioned in front of the articulated device and seats within the hook 30. The objects such as clothes, etc. then hang behind the strap. In this manner, as additional articles are supported by the articulated device, the strap 12 flexes outwardly away from the vertical support surface to accommodate the additional garments. When the lower end of the strap is grasped and the articulated support is pulled outwardly away from the vertical support surface, the hook suspended display devices remain vertical and, therefore, the articles become separated. Therefore, the articulated support provides for ready placement and removal of the hook suspended display devices. The strap may be easily manufactured from suitable flexible plastic and made by conventional extrusion processes.

As best seen in FIGS. 3 and 4, a grasping ring 40 may be attached to the lower end of the articulated support to increase the ease with which the support may be swung outwardly. Preferably, the ring 40 includes an elongated slot 42 adjacent one end thereof. The strap 12 is passed through this slot 42 as it is looped around the end wall 28 of the lowermost link 14.

Various arrangements may be employed for securing the upper end of the strap to a support member. The attachment member 18 illustrated in FIGS. 1, 2 and 8 includes a generally U-shaped bracket 44 having a base portion 46, angled side members 48, and outstanding legs 50.

Figure 8:
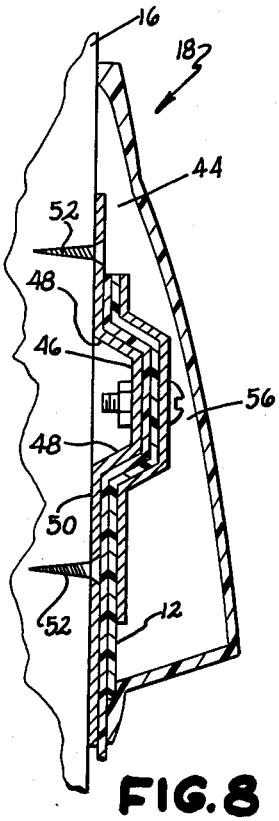
FIG. 8 is a cross-sectional, side elevational view taken generally along line VIII—VIII of FIG. 1.

A similarly configured clamp 54 using suitable fasteners 56 is employed to secure the upper ends of the strap 12 to the bracket 44. As seen in FIG. 8, the ends of the strap 12 are sandwiched between the clamps 54 and the bracket 44 in a serpentine or angled manner. This arrangement securely attaches the somewhat slippery plastic strap to a support surface.

Figure 9:
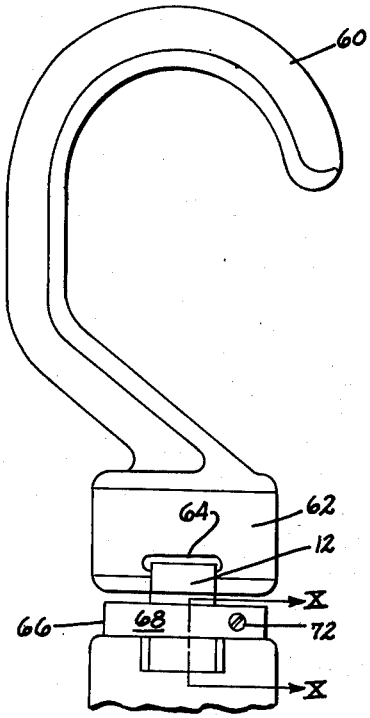
FIG. 9 is a fragmentary, front elevational view illustrating a hook for suspending the article support in accordance with the present invention.
Figure 10:
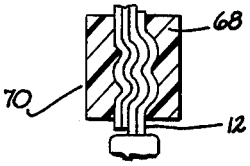
FIG. 10 is a fragmentary, cross-sectional view taken generally along line X—X of FIG. 9.
Figure 11:
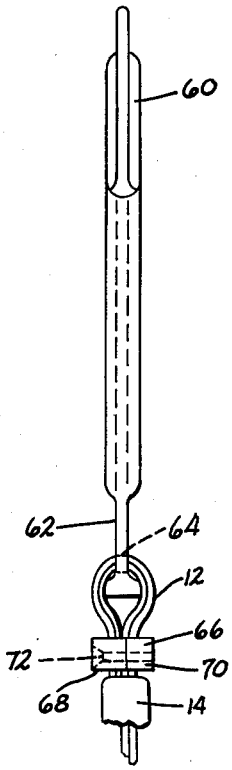
FIG. 11 is a side elevational view of the hook suspension of FIG. 9.

An alternatively securing or hanging arrangement is illustrated in FIGS. 9, 10 and 11. As shown therein, a single support hook 60 includes a lower end 62 having a transverse slot 64 formed therein. The strap 12 is passed through the slot 64 and then doubled back upon itself and secured with a clamp 66. The clamp includes hinged legs 68, 70 having inner surfaces configured in an undulating fashion (FIG. 10). A screw or bolt 72 is employed to clamp the hinged arms or legs 68, 70 about the looped end of the strap.

Figure 12:
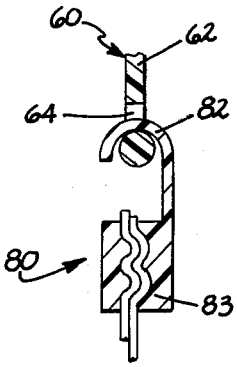
FIG. 12 is a fragmentary, side elevational view in cross section of an alternative arrangement for attaching the article support to the hook of FIG. 9.

As an alternative means for attaching the strap 12 to the hook 60, a clamp 80 including an inverted hook portion 82 and a clamping portion 83 as shown in FIG. 12 may be employed. This arrangement permits ready separation of the articulated support from the support hook 60.

Figure 13:
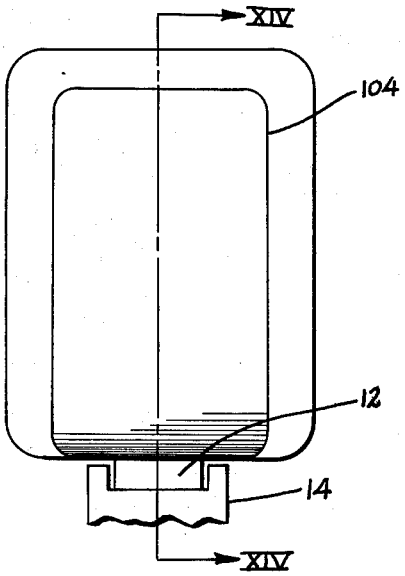
FIG. 13 is a fragmentary, front elevational view of a further alternative embodiment for securing the article support.
Figure 14:
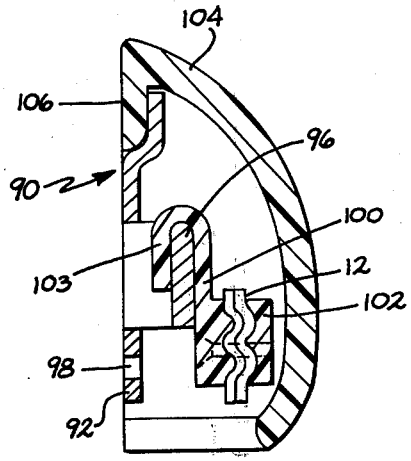
FIG. 14 is a cross-sectional, side elevational view taken generally along line XIV—XIV of FIG. 13.
Figure 15:
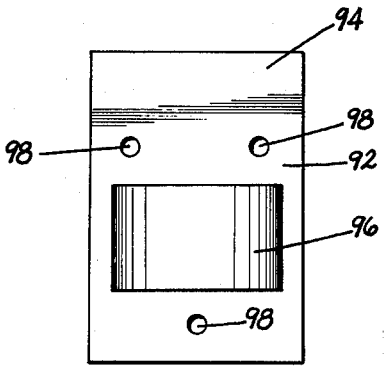
FIG. 15 is a front elevational view showing a portion of the bracket employing the arrangement of FIG. 13.

A further alternative arrangement for securing the end of the tension member to a support surface is illustrated in FIGS. 13, 14 and 15. As shown therein, a bracket 90 is provided including a planar support surface engaging portion 92, a transversely extending, angled upper lip portion 94, and a transversely extending, generally centrally disposed, elevated strap portion 96. Suitable apertures 98 are provided in the bracket 90 for securement to a support surface. An inverted hook-like clamp 100 including a clamplike portion 102 grips the ends of the strap 12. The inverted hook portion 103 is adapted to engage the elevated strap 96 so that the articulated support device may be secured to the bracket 90. A decorative cover 104 may be provided to enclose the brackets and clamp arrangement. The cover 104 includes a transversely extending, inwardly directed lip or flange 106 dimensioned so as to be received between the support surface and the lip 94 of the bracket 90. This provides a positive anchor and index for the cover.

The links must be manufactured from a high strength, high resistance to impact material. Also, the material in most cases must be transparent and, therefore, when viewed resting against the surface of a displayed article it does not objectionably detract from the appearance of the article because it tends to blend into the article colorwise. In similar manner, the strap is made from a transparent or semi-transparent material. One particular material which has proven satisfactory is polyester standard handling material normally used as package strapping. This material has an acceptable degree of translucency, adequate tensile strength, and a low elogation characteristic when subjected to heavy loads over an extended period of time. It has been found that a polycarbonate material meets these specifications. One polycarbonate material which has been successfully used is that sold by Mobay Chemical Company, specification number M-40-1010CL.

The articulated support for hook suspended article display devices in accordance with the present invention efficiently suports a plurality of hanger supported garments or other articles in a spaced, vertical, relationship. This arrangement shows or displays a short segment of each of the articles supported on it and may easily be swung away from the support surface permitting the articles to hang vertically in a separated fashion. This results in easy removal of individual articles as well as placement on the support device. Since a flexible tension member is employed with the display arrangement, it is substantially easier to swing the device outwardly when compared with a device employing a rigid support. The strap-like member also increases the resistance of the support to twisting.

The invention has a number of additional advantages in the merchandising field. It provides an effective display means which can be hung from walls, racks, pillars, in fact, any type of surface or rigid support. Thus, it makes it possible to utilize numerous retail store areas which are now wasted. This frees valuable floor space for other types of merchandise. The net result is greater exposure of available products.

When the invention is equipped with a support hook such as shown in FIG. 12, the entire display can be readily taken down to show customers. It also can be quickly changed by substituting one loaded article support for another. It is possible to ring at both ends, to facilitate holding the device when taken down to show a customer.

Various modifications to the present invention as illustrated and described will undoubtedly become apparent to those of ordinary skill in the art. For example, the specific shape of the individual link members 14 may be varied, the primary requirement being that they may be adaptable for sliding asssembly upon an elongated, flexible support member. Another aspect of the invention is its utility in home use to provide vertical compact storage; an important advance in storage as costs are forcing space reductions in new housing units. Therefore, it is expressly intended that the above description should be considered as that of the preferred embodiment only. The true spirit and scope of the present invention will be determined with reference to the appended claims.

The embodiments of the invention in which an exclusive property or privilege is claimed are defined as follows.

1. An articulated article support for hook suspended article display devices, comprising:

an elongaed, flexible tension load supporting member;

a plurality of links slidably mounted end to end on said load supporting member, each of said links including an outwardly projecting hook and ends rounded in a fore and aft direction to permit said links to articulate about each other and to prevent the application of a severe tension load to said load supporting member when the lower end thereof is pulled outwardly; and means attached to said load supporting member for securing one end of said member to a support surface.

2. An articulated article support as defined by claim 1 wherein each of said links includes:

a front wall, said hook projecting outwardly from said front wall;

a pair of side walls integral with the lateral edges of said front wall; and an end wall at each end of said link extending transversely of said support, connecting said side walls, and offset rearwardly from said front wall to form a transverse slot at each end of said link through which said tension load supporting member extends, said links ech including means engaging said supporting member for increasing the frictional force between the inner face of said front wall and said supporting member.

3. An article support as defined by claim 2 wherein said flexible, tension load supporting member is an elongated strap having a width substantially greater than its thickness whereby resistance to twisting is provided and wherein said frictional force increasing means comprises the inner surface of said front wall being curved.

4. An article support as defined by claim 3 further including a transverse web extending between said side walls intermediate the ends thereof and spaced a distance from said top wall so that said strap curves over the top face of said web as it passes through said slots.

5. An article support as defined by claim 4 wherein said strap extends through the slots in the ends walls of each of said links, loops around the end wall of the lowermost link, and extends back up through the slots of the remaining links between said web and said top wall of each link so that said strap extends in double thickness the length of said article support.

6. An article support as defined in claim 5 further including a gripping ring having a slot therein through which said strap passes as it loops around the end wall of the lowermost link.

7. An article support as defined in claim 3 wherein said securing means comprises:

a generally U-shaped bracket having a base portion, depending side portions, and outwardly extending leg portions, said leg portions adapted for securement to a support surface;

a generally U-shaped clip having a base portion and depending leg portions, said tension member extending between said clip and said bracket, said clip being secured to said bracket; and a decorative cover secured to the support surface and thereby cover said securing means.

8. An article support as defined by claim 3 wherein said strap loops around the end wall of the lowermost link and extends back up through the slots of the remaining links so that said strap extends in double thickness the length of said article support.

9. An article support as defined by claim 6 wherein said securing means comprises:

a generally U-shaped bracket having a base portion, depending side portions, and outwardly extending leg portions, said leg portions adapted for securement to a support surface; and a generally U-shaped clip having a base portion and depending leg portions, the ends of said tension member extending between said clip and said bracket, said clip being secured to said bracket.

10. An article support as defined by claim 9 further including a decorative cover adapted to be secured to the support surface and thereby cover said securing means.

11. An article support as defined by claim 1 wherein said securing means comprises:

a support hook, the stem of said hook having a transversely extending slot, said tension member extending through said slot and then being doubled back against itself; and a clamp positioned around said tension member between the uppermost link and said support hook and clamping the doubled back portion of said member together.

12. An article support as defined by claim 6 wherein said securing means comprises:

a support hook, the stem of said hook having a transversely extending slot, the ends of said tension member extending through said slot and then being doubled back against itself; and a clamp positioned around said tension member between the uppermost link and said support hook and clamping the doubled back portion of said member together.

13. An article support as defined by claim 6 wherein said securing means comprises:

a bracket including a planar support surface engaging portion and a transversely extending elevated strap portion;

a clamp member having an inverted hook portion adapted to engage said bracket strap and a clamp portion gripping the ends of said strap; and a decorative cover engaging said bracket and enclosing said bracket and clamp member.

14. An articulated article support having a flexible tension supporting member and a plurality of elongated links; said links each having a lengthwise extending passageway therethrough for receiving said supporting member whereby said links are arranged in tandem along said member; a hook extending outwardly from each of said links and means on said links cooperating with and engaging said supporting member for holding said links from rotation about or misadjustment with respect to said supporting member, said supporting member being a generally ribbon-like strap having a cross-sectional width substantially greater than its fore and aft thickness, said means being a passageway extending lengthwise of said links having a cross-sectional shape such that the walls of the passageway fit closely about said strap, and said passageway is situated approximately midway between the front and back of said links and said ends of said links are rounded in a fore and aft direction to permit said links to articulate about each other in a fore and aft direction without applying an elongation creating load to said strap.

15. An articulated article support as described in claim 14 wherein said forwardly projecting hook is integral with each of said links.

16. An articulated article support as described in claim 15 wherein said hook is at the lower end of the link when said article support is suspended in a generally vertical attitude.

17. An articulated article support having a flexible tension supporting member and a plurality of elongated links the ends of which are rounded in a fore and aft direction to permit said links to articulate about each other; said links each having a lengthwise extending passageway therethrough for receiving said supporting member so that said links are arranged in tandem along said member and are slidable thereon; a hook extending outwardly from each of said links and means on said links cooperating with and engaging said supporting member for holding said links from rotation about or misadjustment with respect to said supporting member and for increasing the frictional force between said links and said supporting member to thereby restrain sliding motion.

18. An articulated article support as described in claim 17 wherein said supporting member is a strap, said strap being generally ribbon-like having a width substantially greater than its fore and aft thickness; said means being said passageway extending lengthwise of said links having a cross-sectional shape such that the walls of the passageway fit closely about said strap and said passageway traces a curved path.

19. An articulated article support as described in claim 18 wherein each of said links has a laterally extending front wall and a web spaced from said front wall, said web having portions extending into said passageway causing said passageway and the strap to trace a serpentine path through each of said links restraining sliding motion of said links on said strap.

20. An article support as described in claim 17 wherein means are provided for securing one end of said strap to a support from which said article support can be suspended; a ring secured to the other end of said strap to facilitate manipulation of said article support.

21. An article support as described in claim 17 wherein said links are generally transparent plastic material to reduce their visual significance.

22. An article support as described in claim 17 wherein said flexible tension supporting member comprises a strap and wherein both said links and said strap are of transparent or semi-transparent plastic material to reduce their visual significance.

23. An articulated article support having a flexible tension supporting member and a plurality of elongated links; said links each having a lengthwise extending passageway therethrough for receiving said supporting member whereby said links are arranged in tandem along said member; a hook extending outwardly from each of said links, means on said links cooperating with and engaging said supporting member for holding said links from rotation about or misadjustment with respect to said supporting member, means for securing one end of said supporting member to a support from which said article support can be suspended; and a ring secured to the other end of said supporting member to facilitate manipulation of said article support, said supporting member extends in double thickness the length of said article support and is looped through said ring.

24. An articulated article support as described in claim 23 wherein said means for holding said links from rotation comprises:

said passageway extending lengthwise of said links having a lengthwise cross-sectional shape such that the walls of said passageway fit closely about said supporting member.

25. An articulated article support as described in claim 21 wherein each of said links includes a front wall from which said hook extends, a pair of side walls integral with the lateral edges of said front wall and end walls, one at each end of said link and offseet rearwardly from said front wall to form a transverse slot at each end of said link, said front wall and said end walls defining said passageway.

26. An articulated article support as described in claim 23 wherein the ends of said links are rounded in a fore and aft direction to permit said links to articulate about each other in a fore and aft direction without applying an elongation creating load to said supporting member.

27. An articulated article support comprising an elongated flexible tension member of rectangular cross section having a width substantially greater than its thickness and a plurality of elongated links slidably arranged in tandem end to end relationship along said member; said links each having a lengthwise extending passage through which said member extends; said passage having a transverse cross-sectional shape to seat closely about said member and a lengthwise cross-sectional shape to cause said member to trace a nonlinear path and increase the frictional force between said links and said tension member whereby said links are restrained against rotation about said member and sliding on said member; each of said links having a hook projecting from one face thereof to provide an article support.

28. An articulated article support as described in claim 24 wherein portions of said passage in each link are offset normal to the plane of the width of said member whereby frictional contact between said links and said member is increased.

29. An articulated article support as described in claim 24 wherein said passageway lengthwise cross-sectional shape defines a curved path.

30. An articulated article support as described in claim 25 wherein the inner surface of said front wall within said passageway is curved to thereby force said supporting member to trace a curved path through each link.

31. An articulated article support as described in claim 25 further including a transverse web extending between said side walls intermediate the ends thereof and spaced a distance from the inner surface of said top wall, said supporting member curving over said web as it passes through said passageway.

32. An articulated article support as described in claim 30 wherein the ends of said links are rounded in a fore and aft direction to permit said links to articulate about each other in a fore and aft direction without applying an elongation creating load to said supporting member.

33. An articulated article support as described in claim 31 wherein the ends of said links are rounded in a fore and aft direction to permit said links to articulate about each other in a fore and aft direction without applying an elongation creating load to said supporting member.

* * * * *